US005139414A

United States Patent [19]

Nakamoto et al.

[11] Patent Number: 5,139,414

[45] Date of Patent: Aug. 18, 1992

[54] BURNER HAVING PRIMARY AND SECONDARY COMBUSTION CHAMBERS

[75] Inventors: Mitsuyoshi Nakamoto, Nara; Tatsuo Fujita, Osaka; Sachio Nagamitsu, Kyoto; Kenji Okamoto; Kenkichi Hashido, both of Nara, all of Japan

[73] Assignee: Matsushita Electric Industrial Co., Ltd., Osaka, Japan

[21] Appl. No.: 496,207

[22] Filed: Mar. 20, 1990

[51] Int. Cl.[5] ..... F23C 5/28

[52] U.S. Cl. ..... 431/176; 431/178; 431/179; 431/10

[58] Field of Search ..... 431/2, 10, 351, 353, 431/174, 175, 176, 165, 178, 179

[56] References Cited

U.S. PATENT DOCUMENTS 3,746,498 7/1973 Stengel ..... 431/10
4,427,362 1/1984 Dykema ..... 431/10
4,517,165 5/1985 Moriarty ..... 431/2
4,909,728 3/1990 Nakamoto et al. ..... 431/176

FOREIGN PATENT DOCUMENTS 161308 7/1988 Japan ..... 431/2
107010 4/1989 Japan ..... 431/10
114606 5/1989 Japan ..... 431/10

*Primary Examiner*—James C. Yeung
*Attorney, Agent, or Firm*—Wenderoth, Lind & Ponack

[57] ABSTRACT

A burner has first and second nozzles communicated with a combustion chamber and defined in a wall structure surrounding the combustion chamber. The first and second nozzles are opposed to each other and positioned adjacent an exit opening of a fuel supply passage that is defined in the wall structure. The burner also has first and second secondary air supply ports defined in the wall structure adjacent the exit of the combustion chamber in opposition to each other.

14 Claims, 3 Drawing Sheets

BURNER HAVING PRIMARY AND SECONDARY COMBUSTION CHAMBERS

BACKGROUND OF THE INVENTION

1. Field of the Invention

The present invention relates to a burner for industrial and household use having a wide range of adjustability in terms of the quantity of heat for a given quantity of fuel supplied, i.e., a wide range of the turn-down ratio (the ratio of the minimum fuel flow relative to the rated fuel flow).

2. Description of the Prior Art

A partial premixing type burner is currently widely used as an industrial burner and a household burner. In the partial premixing type burner, it is well known that an air-fuel mixture is ignited at burner ports to form premixed flames which in turn bring about diffusion flames when a secondary air is supplied into the premixed flames from the surroundings of the premixed flames. On the other hand, in a Smithells burner, the premixed flames and the diffusion flames are separated while a secondary air is supplied from the surroundings of the diffusion flames.

However, with the burner of a type wherein the diffusion flames are formed around the premixed flames, it has often been observed that, when the quantity of heat is low or when the excess air ratio of the premixed gas approaches 1, the burner tends to exhibit an abrupt increase in temperature to such an extent as to result in back-firing. When the amount of air in the premixed gas is increased to increase the excess air ratio, or when the amount of fuel is increased to increase the flow rate of the fuel, the flames tend to become unstable, the burner tends to emit a relatively large amount of unburned components of the air-fuel mixture and flame blow-off tends to occur. Because of this, the adjustable range of the quantity of heat and that of the air are so small as to be inconvenient in use.

On the other hand, with the Smithells burner, there has been found a problem in that, where the excess air ratio of the premixed gas is greater or smaller than 1, the premixed flames tend to become unstable.

SUMMARY OF THE INVENTION

Accordingly, the object of the present invention is to provide an improved burner of a type having a large range of adjustment of the quantity of heat produced for a given quantity of fuel and that of the air supplied, that is, having a large turn-down ratio (TDR).

To this end, the burner according to a first preferred embodiment of the present invention has first and second nozzles communicated with a combustion chamber and defined in a wall structure surrounding the combustion chamber. The first and second nozzles are opposed with each other and positioned adjacent an exit opening of a fuel supply passage that is defined in the wall structure. The burner also has secondary air supply ports defined in the wall structure adjacent the exit of the combustion chamber in opposition to each other.

The burner according to a second preferred embodiment of the present invention has first and second nozzles communicated with a combustion chamber and defined in a wall structure surrounding the combustion chamber. The first and second nozzles are opposed to each other and positioned adjacent an exit opening of a fuel supply passage means that is defined in the wall structure. The burner also has secondary air supply ports defined in the wall structure adjacent the exit of the combustion chamber in opposition to each other, the combustion chamber being surrounded by a cooling air passage means positioned externally of the combustion chamber. The fuel supply passage employed in this burner is also positioned externally of the combustion chamber.

In a burner according to a third preferred embodiment of the present invention, the secondary air flows externally of the fuel supply passage to pre-heat a premixed gas.

Thus, according to the first preferred embodiment of the present invention, since the premixed flames undergo combustion even when they emerge outwardly from the nozzles, combustion is possible in a region where air is abundant without flame blow-off, even though the heat quantity is high. In particular, the premixed flames formed adjacent the nozzles located in the vicinity of the discharge opening of the combustion chamber are stabilized, because the premixed gas can be pre-heated by exhaust gases of high temperature produced by the premixed flames formed at the nozzles, which are located remote from the discharge opening of the combustion chamber. Also, since the flames are dispersed, a stable combustion takes place even where the combustion chamber is of a small volume. Even the partial premixed gas is diffused with the secondary air, supplied through the secondary air supply port and, therefore, the unburned components of the partial premixed gas can be substantially completely burned.

According to the second preferred embodiment of the present invention, the outside of the combustion chamber is cooled by the cooling air to keep the combustion chamber defining wall structure at a low temperature.

According to the third preferred embodiment of the present invention, the premixed gas can be heated by the air heated exteriorly of the combustion chamber defining wall wall structure to facilitate a stabilization of the premixed flames. Also, air is utilized as the secondary air to enhance combustibility of the diffusion flames.

BRIEF DESCRIPTION OF THE DRAWINGS

These and other objects and features of the present invention will become clear from the following description taken in conjunction with preferred embodiments thereof with reference to the accompanying drawings, in which.

DETAILED DESCRIPTION OF THE EMBODIMENT

Figure 1:
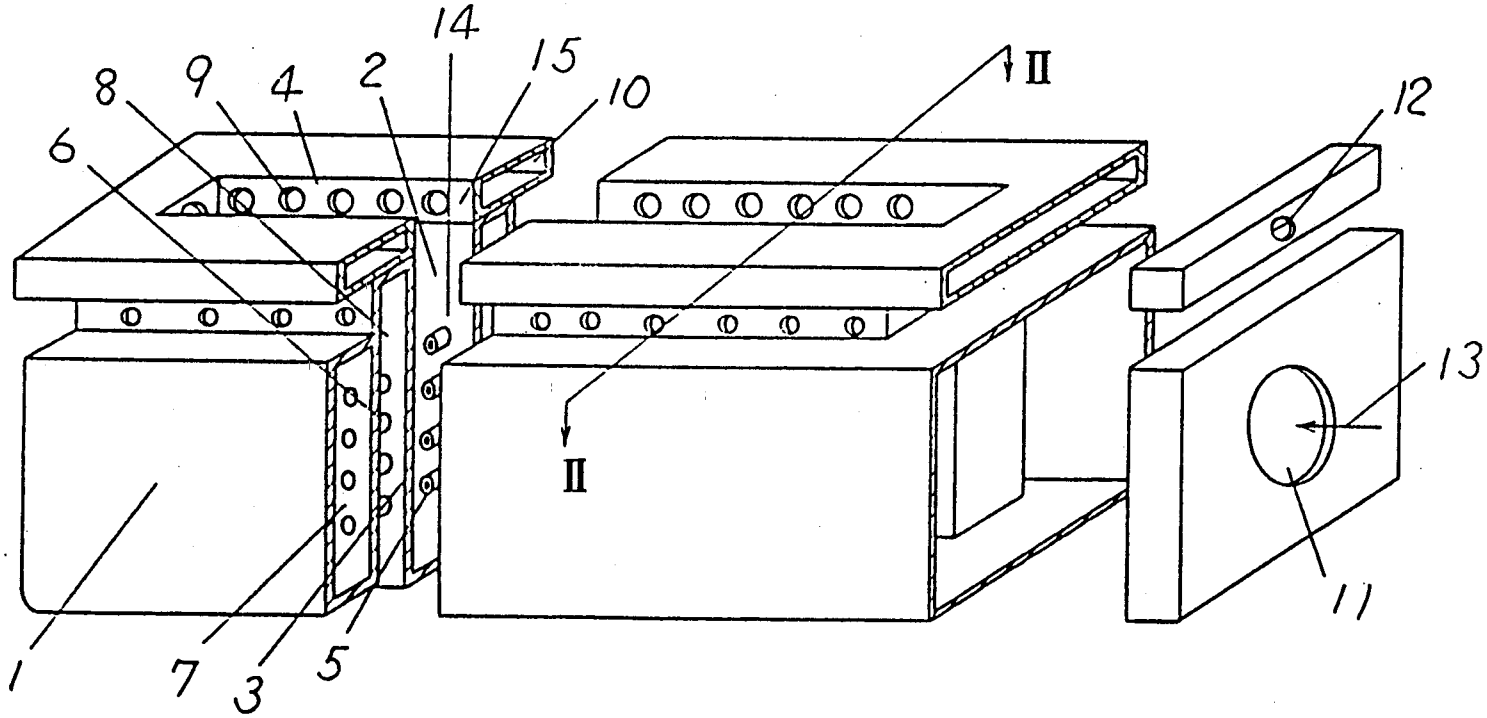
FIG. 1 is a schematic perspective view, with a portion shown in section, of a burner according to a first preferred embodiment of the present invention.

FIG. 1 illustrates a schematic perspective view of a burner according to a first preferred embodiment of the present invention. The burner shown therein comprises a burner housing structure 1 having a combustion chamber 2 defined therein and delimited by a chamber defining wall 3. The combustion chamber 2 is open to the outside through a discharge opening 4. The chamber defining wall 3 includes a plurality of nozzles 5. The burner has fuel supply passages defined at 6, a branch tube defined at 7 and a coolant supply passage defined at 8. Secondary air supply ports 9 are defined at a top region of the combustion chamber so as to open into the discharge opening 4 for the supply of secondary air, supplied through the secondary air supply port 9 into the discharge port 4. Reference numeral 11 represents a fuel supply port and reference numeral 13 represents a premixed gas. It is to be noted that the combustion chamber 2 is comprised of a primary combustion chamber 14 and a secondary combustion chamber 15.

Figure 2:
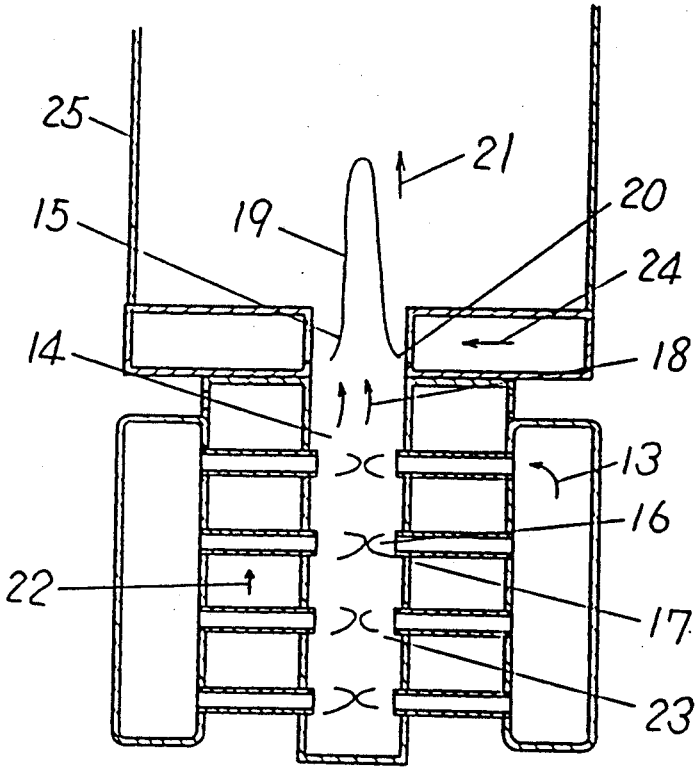
FIG. 2 is a cross-sectional view of a burner according to the first embodiment of FIG. 1.

FIG. 2 illustrates the cross-sectional representation of the burner shown in FIG. 1. As shown therein, a heat exchanger 25 is disposed downstream, of, i.e. above, the combustion chamber 2. Reference numeral 16 represents flames emerging from the paired nozzles 5 in a direction confronting with each other to form opposed flames or twin flames. Reference numeral 18 represents unburned components of the air-fuel mixture; reference numeral 19 represents secondary flames; reference numeral 20 represent a stem of the secondary flames; reference numeral 21 represents exhaust gases; reference numeral 22 represents a cooling air; reference numeral 23 represents the stems of the opposed flames; and reference numeral 24 represents a secondary air.

The exhaust gases 21 of high temperature are often used as a source of heat either directly or through the heat exchanger 25 positioned above the combustion chamber 2. The premixed gas 13 is mixed with combustion air and is introduced through the fuel supply port 11. The premixed gas 13 so introduced through the fuel supply port 11 flows through the branch tube 7 and then flows into the fuel supply passages 6 before being introduced into the combustion chamber 2 through the paired nozzles 5. Each of the fuel supply passages 6 is constituted by a tube having an elongated passage defined therein and extending exteriorly of the chamber defining wall 3.

When the premixed gas 13 is ignited, the flames 16 and the opposed flames 17 are formed. Where a liquid fuel is employed in place of a gaseous fuel, the liquid fuel can undergo combustion in a manner similar to the gaseous fuel, provided that the liquid fuel is vaporized, and can therefore bring about effects similar to those afforded by the use of the gaseous fuel in the illustrated burner.

The nozzles 5 are paired in the sense that one of the nozzles positioned on one of the opposite sides of the combustion chamber 2 is aligned with another one of the nozzles positioned on the other of the opposite sides of the combustion chamber 2. Thus, the flames 16 emerging from the nozzles on one of the opposite sides of the combustion chamber 2 and the flames 16 emerging from the nozzles on the other of the opposite sides of the combustion chamber 2 approach each other at the same distance to thereby form the opposed or twin flames 17. Similarly, the fuel supply passages 6 are paired in correspondence with the paired nozzles 5 and are disposed outside the chamber defining wall 3. These fuel supply passages 6 are arranged in a group between the chamber defining wall 3 and the branch tube 7 to thereby form the cooling passage 8 through which the cooling air 22 flows. The branch tube 7 is divided into several passage portions, between which the cooling air 22 can flow, so that radiant heat from the chamber defining wall 3 can be discharged to the outside. The cooling air 22, if heated, is often used as a source of heat. While the opposed flames 17 are formed within the combustion chamber 2 as hereinbefore described, heat brought about by the flames 16 is used to heat both the chamber defining wall 3 and the fuel supply tubes 6.

Radiation of heat takes place from the chamber defining wall 3 and the fuel supply tubes 6 and, therefore, the temperature of the chamber defining wall 3 can be lowered. Both the chamber defining wall 3 and the fuel supply passages 6 are made of heat resistant material such as, for example, stainless steel, for the purpose of facilitating the radiation of heat. The outside of the chamber defining wall 3 heated by the flames 16 defines the cooling air passage 8 and, therefore, the flow of the cooling air 22 through the cooling air passage 8 facilitates a lowering of the temperature of the chamber defining wall 3 to avoid any possible back-firing of the flames 16.

At this time, the fuel supply passages 6 can also be cooled by the cooling air in a similar fashion. Although portions of the premixed gas 13 flowing through the fuel supply passages 6 in contact with an inner peripheral surface of each fuel supply passage 6 tends to be cooled, the cooling does not extend to a core portion of the flow of the premixed gas 13 with in the fuel supply passages 6. Accordingly, the average temperature of the premixed air 13 will not be lowered appreciably and, therefore, the fuel as a whole will not be deteriorated.

While the present invention is characterized in the formation of and the utilization of the opposed flames 17 in the burner, the details of the opposed flames 17 will now be discussed. As hereinbefore described, some of the nozzles 5 on one side of the combustion chamber 2 and the others of the nozzles 5 on the opposite side of the combustion chamber 2 are axially aligned with each other and, therefore, the flames 16 emerging from such some of the nozzles 5 confront the flames 16 emerging from such others of the nozzles 5 to form the opposed flames 17. The opposed flames 17 exhibit a higher velocity of flow from the associated nozzles 5 than that exhibited by a Bunsen burner, however they are not accompanied by a blow-off.

If the velocity of flow of the premixed gas 13 is low, the respective stems 23 of the opposed flames adhere to the nozzles 5. However, if the velocity of blow of the premixed gas 13 is high, the respective stems 23 of the opposed flames may depart from the nozzles 5. Consequently, fuel may partially flow out from the stems 23 between the nozzles 5 and the opposed flames, such fuel being oxidized by some of the opposed flames 17 formed at the downstream side.

Where the premixed gas 13 is a partial premixed gas, it will form an incompletely combusted gas after having been combusted by the opposed flames 17. This incompletely combusted gas can be completely burned in the presence of the secondary air 24, supplied through the secondary air supply ports 9, to thereby form exhaust gases 21.

At this time, since the opposed flames and secondary flames are formed separate from each other, a temperature increase in the chamber defining wall can be avoided. Since the secondary flames are formed over the entire opening of the secondary combustion chamber 15 and, therefore, the velocity of flow of the incompletely combusted gas can be set to be lower than the velocity of flow of the fuel, the stability of the secondary flames is very high.

The combustion gases of high temperature produced by the flames 16 formed at some of the nozzles 5 upstream of the combustion chamber 2 are supplied to the flames formed at some of the nozzles 5 downstream of the combustion chamber 2 to pre-heat the premixed air emerging from the nozzles 5. As a result of this, the stabilization of the downstream flames can be secured. At this time, the flow of the gaseous fuel takes place in the vicinity of the stems of the opposed flames 17, that is, in the vicinity of the nozzle 5, and will not heat the flames as a whole.

With the fuel flow velocity being lowered, the flames 16 tend to enter the nozzles 5. At this time, both the chamber defining wall 3 and the fuel supply passages 6 are cooled by the cooling air 22. Accordingly, the flow of the flames 16 upstream into the fuel supply passages 6, that is, the back-firing, will not occur. The premixed gas will be cooled, and therefore, the flames 16 can be stabilized in the vicinity of the nozzles 5.

Each of the fuel supply passages 6 is in the form of an elongated tube and, therefore, if the ratio of the length L of each fuel supply passage 6 relative to the inner diameter D, that is, L/D, is great, the premixed gas will exhibit a Poiseuille flow. When the premixed gas exhibits the Poiseuille flow, respective ends of the opposed flames 17 approach the nozzle and, therefore, not only can the emission of unburned components be minimized, but complete combustion can be facilitated. This is particularly true where the ratio L/D is equal to or greater than 4, that is, $L/D \geqq 4$.

Where the heat exchanger 25 is disposed downstream of the combustion chamber 2, both the chamber defining wall 3 and the fuel supply passages 6 form a part of the heat exchanger 25, making it possible to utilize the cooling air as a heat source and, accordingly, the heat exchanger 25 utilizable in the burner according to the present invention can be made compact.

Figure 3:
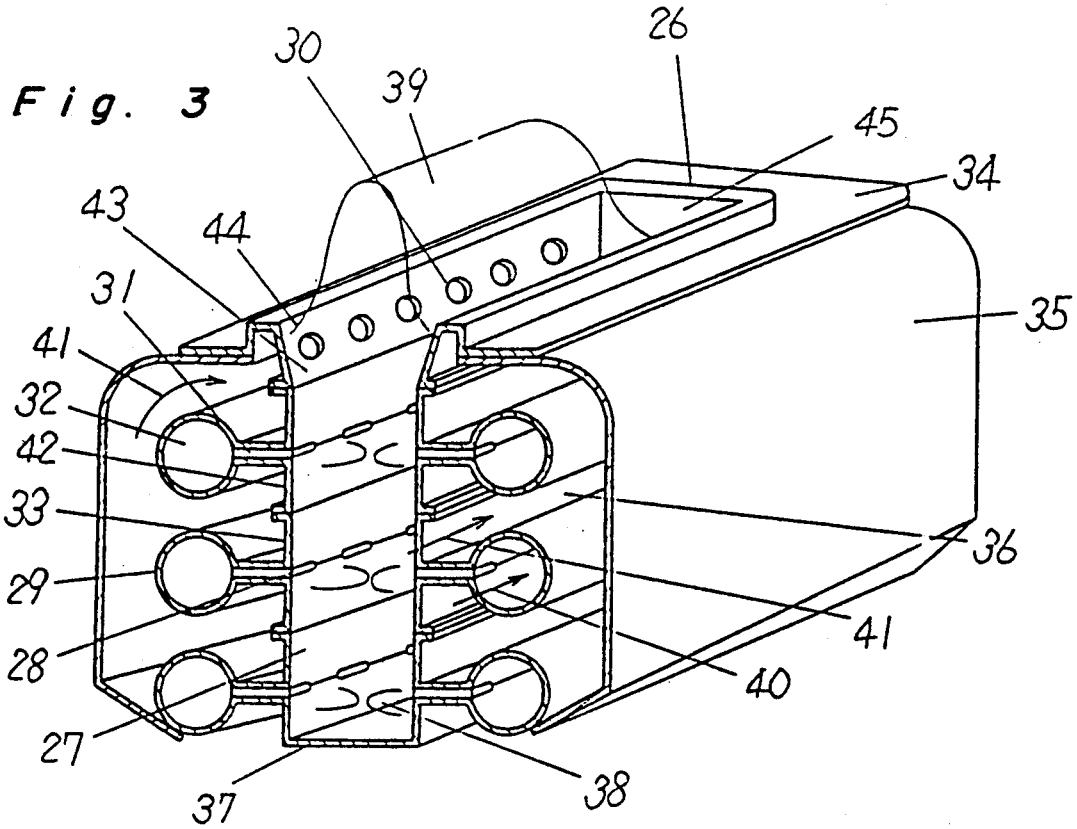
FIGS. 3 and 4 are perspective views, with a portion cut away, of the burner according to second and third preferred embodiments of the present invention, respectively.

FIG. 3 illustrates a burner according to another preferred embodiment of the present invention. Referring to this figure, reference numeral 26 represents a burner assembly; reference numeral 27 represents a combustion chamber; reference numeral 28 represents nozzles; reference numeral 29 represents burner headers; and reference numeral 30 represents secondary air supply ports. Reference numeral 31 represents fuel supply passages; reference numeral 32 represents fuel supply branch tubes; reference numeral 33 represents header flanges; reference numeral 34 represents a burner covering; reference numeral 35 represents secondary air coverings; reference numeral 36 represent secondary air passages defined by the secondary air coverings 35; reference numeral 37 represents a generally rectangular bottom plate; reference numeral 38 represents opposed flames; and reference numeral 39 represents secondary flames.

Reference numeral 40 represent a premixed gas; reference numeral 41 represents a secondary air; reference numeral 42 represents walls defining a primary combustion chamber; and reference numeral 43 represents walls defining a secondary combustion chamber. The burner header 29 is constituted by the fuel supply branch tubes 32, the fuel supply passages 31 communicated with the respective branch tubes 32, and the header flanges 33. One side of each fuel supply branch tube 32 adjacent the combustion chamber 27 forms nozzles 28 that are communicated with the combustion chamber 27. The secondary air supply ports 30 are formed in the burner covering 34 so as to oppose each other in a paired fashion.

Each chamber defining wall 42 forming a part of the combustion chamber 27 is formed by arranging the plural header flanges 33 in a generally a butted fashion in a plane, the bottom of the combustion chamber 27 being delimited by the bottom plate 37. When so formed, the nozzles 28 are defined in the chamber defining wall 42. The secondary air supply ports 30 are defined in a downstream portion of the combustion chamber 27 in an oppositely paired fashion similar to the paired nozzles 28. The premixed gas 40, which is a mixture of fuel with primary air is supplied into the fuel supply branch tubes 32 forming the burner header 29.

The secondary air supply passages 36 are delimited by the burner header 29, the secondary air coverings 35 and the burner covering 34. Each of the fuel supply branch tubes 32 is provided with the plural fuel supply passages 31. When the premixed gases 40 emerging outwardly from the nozzles 28 communicated with the fuel supply passages 31 are ignited, the opposed flames 38 can be formed in the combustion chamber 27. If the excess air ratio of the premixed gases is not greater than 1, the secondary flames 39 are formed by the secondary air 41 supplied through the secondary air supply ports 30.

Portions of the heat used to heat the header flanges 33 and combusted gases of high temperature are used for heating.

In one aspect, the second preferred embodiment of the present invention is featured in the formation of the secondary flames. These secondary flames 39 are formed by the combustion gases, produced as a result of the formation of the opposed flames 38, in admixture with the secondary air 41 supplied through the secondary air supply ports 30. The secondary flames 39 so formed have their stems 44 formed in the vicinity of the secondary air supply ports 30 while respective tips of the secondary flames 39 are so closed as to accomplish a complete combustion.

The walls 43 defining the secondary combustion chamber are so arranged as to confront each other while spreading in a direction conforming to the direction of flow of the combustion gases. The secondary air 41 supplied through the secondary air supply ports 30 flows in a direction towards a discharge opening 45 of the combustion chamber 27 in a generally inclined fashion. Because of the inclined flow of the secondary air 41 as hereinabove described, the secondary air 41 will not flow in a direction towards the opposed flames 38 and, therefore, the secondary air can be supplied without adversely affecting the opposed flames.

In another aspect, the second preferred embodiment of the present invention is also featured in the cooling of the chamber defining walls 42 with the secondary air 41. Specifically, the secondary air 41 flows between the header flanges 33 and the branch tubes 32 to cool the chamber defining walls 42. Since in the burner embodying the present invention the flames can be formed at locations away from the nozzles 28, the cooling of the chamber defining walls 42 would not adversely affect the stability of the opposed flames 38. In other words, without lowering the temperature of the flames, the temperature of the chamber defining walls 42 can be lowered. Accordingly, the lifetime of the chamber defining walls 42 can be increased and high temperature combustion gases can be produced. At this time, although the chamber defining walls 42 have been described as cooled by the secondary air 41, other cooling air than the secondary air may be employed for this purpose.

In a further aspect, the second preferred embodiment of the present invention is featured in the utilization of the secondary air of high temperature. The secondary air 41 heated by the chamber defining walls 42 is supplied from the secondary air supply ports 30, positioned rather closer to the discharge opening 45 of the combustion chamber 27 than to the nozzles 28. The secondary flames 39 undergo complete combustion in admixture with the secondary air 41 of high temperature. Since the opposed flames 38 and the secondary flames 29 are apart from each other, there is no possibility that both of the nozzles 28 and the chamber defining walls 42 may be heated to a high temperature. In other words, the supply of the secondary air of high temperature would not result in an increase the temperature of the burner.

Figure 4:
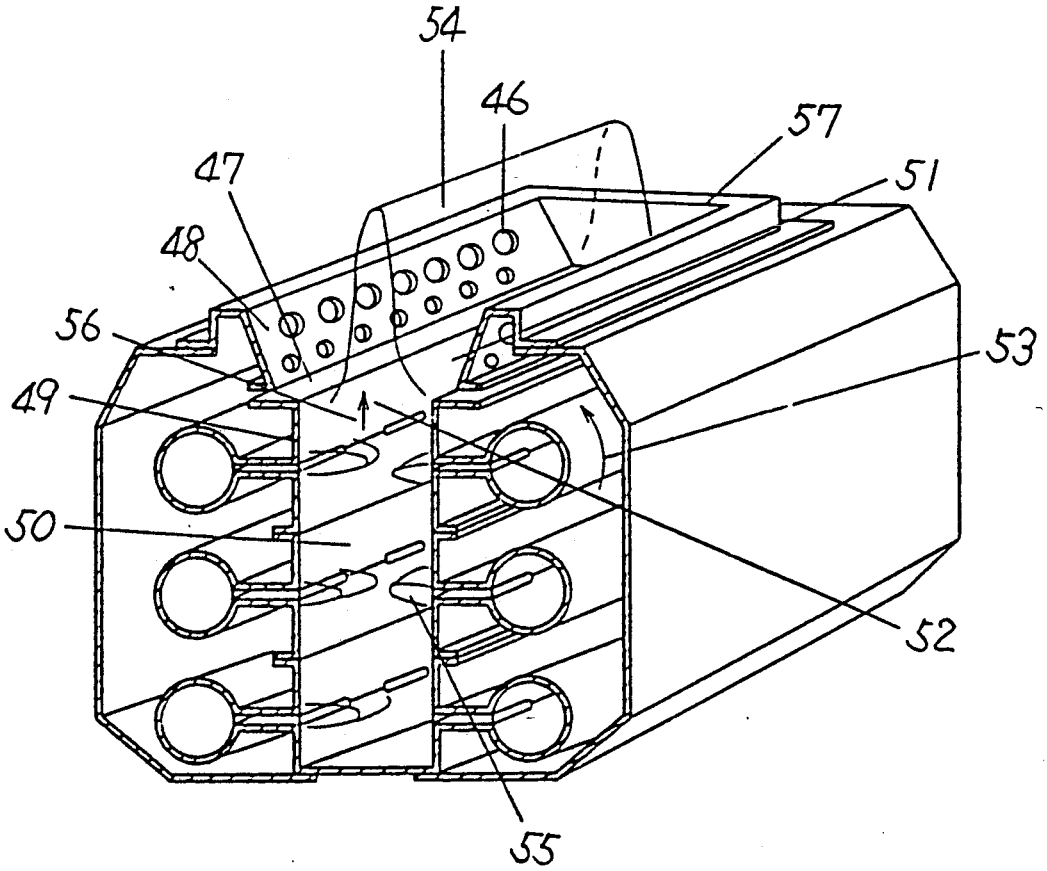

FIG. 4 illustrates a third preferred embodiment of the present invention. The burner according to the third preferred embodiment of the present invention is substantially similar to that according to the second preferred embodiment of the present invention shown in and described with reference to FIG. 3. The burner shown in FIG. 4 is provided with a slit-shaped air port 47 defined beneath secondary air supply ports 46. Walls 48 defining a secondary combustion chamber 51 have a larger width than that of walls 49 defining a primary combustion chamber 50 and, hence, the secondary combustion chamber 51 has a larger width than that of the primary combustion chamber 50.

The slit-shaped air port 47 is so defined as to continuously encircle a discharge opening 52 of the primary combustion chamber 50 and is operable to supply secondary air 53 in a direction perpendicular to a discharge opening 57 of the secondary combustion chamber 51. Secondary flames 54 form all over the discharge opening 52 of the primary combustion chamber 50. Since the secondary flames 54 are formed continuously over the discharge opening 52, a complete combustion can be accomplished.

Also, if the chamber defining walls 48 are made to have a larger width than that of the chamber defining walls 49, the secondary air having emerged from secondary air supply ports 46 exhibits a reduced velocity of flow as it approaches the secondary flames 54. Therefore, the secondary flames 54 can be stabilized to accomplish the complete combustion.

According to one aspect of the present invention, the burner shown in and described with reference to FIG. 4 is featured in the employment of the slit-shaped air port 47. Since the secondary air 53 can be continuously supplied through the slit-shaped air port 47, the secondary flames 54 can be formed with no discontinuity over the combustion chambers so that the secondary flames 54 can undergo complete combustion.

According to another aspect of the present invention, the burner shown in and described with reference to FIG. 4 is also featured in that the secondary combustion chamber 51 has a larger width than that of the primary combustion chamber 50. The velocity of flow of the secondary air 53 is low at a position where it is supplied into the secondary flames 54. Accordingly, the secondary flames can be stabilized to accomplish the complete combustion.

Thus, according to the present invention, the formation of the plural opposed flames within the combustion chamber and the arrangement of those opposed flames so as to orient towards the discharge opening of the combustion chamber can bring about the following effects. (1) The flames can be stabilized while combustion takes place over a wide range of the quantity of heat as well as the excess air ratio. (2) The arrangement of the heat exchanger at a location adjacent the discharge opening of the combustion chamber, while allowing the cooling air to flow through the cooling passages, makes it possible to reduce the size of the heat exchanger.

The supply of the secondary air in a generally inclined fashion enables the secondary air to be supplied without adversely affecting the opposed flames (premixed flames). Also, the employment of the secondary combustion chamber, having a width larger than that of the primary combustion chamber, effect that the secondary flames can be stably formed to accomplish a complete combustion. Yet, the employment of the slit-shaped secondary air supply port continuously encircling the primary combustion chamber enables the secondary flames to be continuously formed.

Moreover, the cooling of the outside of the primary combustion chamber enables the burner to be cooled without cooling the opposed flames (premixed flames) too much, to prolong the lifetime of the burner. The pre-heating of the secondary air practiced in the present invention is effective to facilitate the complete combustion of the secondary flames, and the pre-heating of the premixed gas flowing through the fuel supply passages is effective to facilitate an increase in temperature of the primary flames without the temperature of the burner increasing, thereby stabilizing the flames.

Although the present invention has been fully described in connection with the preferred embodiments thereof with reference to the accompanying drawings, it is to be noted that various changes and modifications are apparent to those skilled in the art. Such changes and modifications are to be understood as included within the true scope of the present invention as defined by the appended claims, unless they depart therefrom.

What is claimed is:

1. A burner, comprising:

first wall means for defining a primary combustion chamber, said first wall means comprising a plurality of first walls disposed opposite each other in a confronting relationship;

a feed means for feeding a mixture of fuel and air through said first walls into said primary combustion chamber, said feed means including a plurality of paired nozzles in respective opposite said first walls of said primary combustion chamber;

a plurality of fuel supply passage means for communicating with said nozzles and for supplying the mixture of fuel and air to said plurality of nozzles; and second wall means for defining a secondary combustion chamber located downstream of said primary combustion chamber with respect to a direction of flow of combustion gases out of said primary combustion chamber, said second wall means comprising a plurality of second walls disposed opposite to each other in a confronting relationship, and said second walls having a plurality of paired air supply ports.

2. The burner of claim 1, wherein:

said plurality of nozzles has an exit end disposed inside said primary combustion chamber and an inlet end outside of said primary combustion chamber spaced from the respective said first walls; and said plurality of fuel supply passage means comprises a plurality of passage connected with said inlet ends of said nozzles and spaced from said first walls.

3. The burner of claim 2, wherein said plurality of passages surround said primary combustion chamber, are interconnected with each other, and have a common source for the mixture of fuel and air.

4. The burner of claim 2, and further comprising cooling means for cooling said first walls of said primary combustion chamber, said cooling means comprising an air passage for cooling air, said air passage extending adjacent said first walls for cooling said primary combustion chamber, said plurality of nozzles and said plurality of fuel supply passage means.

5. The burner of claim 4, wherein said cooling means comprises an open bottom for receiving cooling air therein and a perforated upper portion for distributing cooling air therefrom.

6. The burner of claim 5, wherein said air passage is defined by said first walls of said primary combustion chamber and said plurality of fuel supply passage means.

7. The burner of claim 1, wherein said secondary combustion chamber is wider than said primary combustion chamber.

8. The burner of claim 1, wherein:

said opposite second walls of said secondary combustion chamber diverge with respect to each other in a direction extending downstream of said primary combustion chamber; and said paired air supply ports in said second walls are disposed so as to be opposite each other in respective opposite said second walls.

9. The burner of claim 8, wherein said secondary combustion chamber is wider than said primary combustion chamber.

10. The burner of claim 8, and further comprising a secondary air port in the form of a slit adjacent the discharge end of said primary combustion chamber and completely surrounding said primary combustion chamber for supplying secondary air to said secondary combustion chamber.

11. The burner of claim 1, and further comprising a secondary air port in the form of a slit adjacent the discharge end of said primary combustion chamber and completely surrounding said primary combustion chamber for supplying secondary air to said secondary combustion chamber.

12. A burner, comprising:

first wall means for defining a primary combustion chamber, said first wall means comprising a plurality of first walls disposed opposite each other in a confronting relationship;

a feed means for feeding a mixture of fuel and air through said first walls into said primary combustion chamber, said feed means including a plurality of paired nozzles in respective opposite said first walls of said primary combustion chamber;

a plurality of fuel supply passage means for communicating with said nozzle and for supplying the mixture of fuel and air to said plurality of nozzles;

second wall means for defining a secondary combustion chamber located downstream of said primary combustion chamber with respect to a direction of flow of combustion gases out of said primary combustion chamber; and a cooling air passage means defined outside of said first walls defining said primary combustion chamber for the flow of cooling air therethrough.

13. The burner of claim 12, wherein:

said second wall means comprises a plurality of second walls disposed opposite to each other in a confronting relationship, said second walls having a plurality of air supply ports; and said cooling air passage means is connected to and conducts cooling air to said air supply ports for use as combustion assisting secondary air.

14. A burner, comprising:

wall means for defining a combustion chamber, said wall means comprising a plurality of walls disposed opposite to each other in a confronting relationship, and said combustion chamber having a discharge opening defined by said walls;

a feed means for feeding a mixture of fuel and air through said walls into said combustion chamber, said feed means including a plurality of paired nozzles in respective opposite said walls of said combustion chamber;

a plurality of fuel supply passage means for communicating with said nozzles and for supplying the mixture of fuel and air to said nozzles;

a secondary air supply means for supplying secondary air to said combustion chamber, said secondary air supply means including a plurality of paired air supply ports oppositely disposed in confronting relationships and directed toward said discharge opening of said combustion chamber; and a secondary air passage means defined outside of said walls defining said combustion chamber for flowing secondary air outside of said walls, around said plurality of fuel supply passage means and supplying the secondary air to said combustion chamber through said air supply ports.

* * * * *